US009551482B2

(12) United States Patent
Seward et al.

(10) Patent No.: US 9,551,482 B2
(45) Date of Patent: Jan. 24, 2017

(54) LIGHT FIXTURE ASSEMBLY WITH PIVOTING REFLECTOR ASSEMBLY AND LENS ASSEMBLY

(71) Applicant: Hubbell Incorporated, Shelton, CT (US)

(72) Inventors: Alan D. Seward, Simpsonville, SC (US); Martin C. Werr, Easley, SC (US); David J. Rector, Mauldin, SC (US); Randy K. Lewis, Greenville, SC (US); Raymond A. Brown, Greer, SC (US)

(73) Assignee: Hubbell Incorporated, Shelton, CT (US)

( * ) Notice: Subject to any disclaimer, the term of this patent is extended or adjusted under 35 U.S.C. 154(b) by 269 days.

(21) Appl. No.: 13/687,124

(22) Filed: Nov. 28, 2012

(65) Prior Publication Data

US 2014/0146542 A1 May 29, 2014

(51) Int. Cl.

| | |
|---|---|
| ***F21V 17/06*** | (2006.01) |
| ***F21V 23/02*** | (2006.01) |
| ***F21V 17/18*** | (2006.01) |
| *F21S 8/02* | (2006.01) |
| *F21S 8/04* | (2006.01) |
| *F21Y 103/00* | (2016.01) |
| *F21Y 113/00* | (2016.01) |

(52) U.S. Cl.

CPC ..... *F21V 23/026* (2013.01); *F21V 17/18* (2013.01); *F21S 8/02* (2013.01); *F21S 8/026* (2013.01); *F21S 8/04* (2013.01); *F21Y 2103/00* (2013.01); *F21Y 2113/00* (2013.01)

(58) Field of Classification Search

CPC ..... F21V 17/06; F21V 7/005; F21V 13/04; F21V 19/008; F21S 8/026; F21S 8/02; F21Y 210300

USPC ..... 362/222, 297, 308, 145, 147, 148, 278, 362/299, 300, 319, 322, 326, 327, 328, 362/341, 347, 364

See application file for complete search history.

(56) References Cited

U.S. PATENT DOCUMENTS

| | | | |
|---|---|---|---|
| 3,525,450 | A | 8/1970 | Payson |
| 4,674,015 | A | 6/1987 | Smith |
| 5,012,043 | A | 4/1991 | Seymour |
| 5,042,673 | A | 8/1991 | McShane |
| 5,172,976 | A | 12/1992 | Bogdanovs |
| 6,059,424 | A | 5/2000 | Kotloff |
| 6,964,502 | B1 | 11/2005 | Verfuerth |
| 7,607,795 | B2 | 10/2009 | Engel |

(Continued)

*Primary Examiner* — Laura Tso
*Assistant Examiner* — Naomi M Wolford
(74) *Attorney, Agent, or Firm* — Michael Best & Friedrich, LLP

(57) ABSTRACT

A light fixture assembly includes a housing having an interior surface, a ballast mounted on the interior surface of the housing, a first reflector releasably coupled to the interior surface of the housing, the ballast being substantially enclosed between the housing and the first reflector when the first reflector is in a first, closed position and being exposed when the first reflector is in a second, open position spaced from at least a portion of the interior surface, a lens releasably coupled to the housing, the first reflector being substantially enclosed between the lens and the housing when the lens is in a first, closed position and substantially exposed when the lens is in a second, open position. This construction provides relatively easy and quick access to the ballast for replacement and from below the fixture if it is mounted in or on the ceiling.

20 Claims, 8 Drawing Sheets

(56) References Cited

U.S. PATENT DOCUMENTS

| | | | | |
|---|---|---|---|---|
| 7,611,257 | B2 | 11/2009 | Engel | |
| 7,635,198 | B2 | 12/2009 | Mayfield, III et al. | |
| 7,901,105 | B2 | 3/2011 | Fowler, Jr. et al. | |
| 7,942,545 | B2 | 5/2011 | Kassay et al. | |
| 7,950,833 | B1 * | 5/2011 | Crane et al. | 362/404 |
| 8,038,318 | B2 | 10/2011 | Plunk | |
| 8,042,977 | B1 * | 10/2011 | Nourishad et al. | 362/343 |
| 8,092,041 | B2 | 1/2012 | Fowler, Jr. et al. | |
| 8,272,763 | B1 * | 9/2012 | Chinnam | F21V 29/004 362/147 |
| 2003/0026094 | A1 * | 2/2003 | Plourde et al. | 362/225 |
| 2010/0053947 | A1 * | 3/2010 | Fowler et al. | 362/223 |
| 2010/0091484 | A1 | 4/2010 | Mayfield, III et al. | |
| 2011/0043132 | A1 * | 2/2011 | Kim et al. | 315/294 |

* cited by examiner

LIGHT FIXTURE ASSEMBLY WITH PIVOTING REFLECTOR ASSEMBLY AND LENS ASSEMBLY

FIELD OF THE INVENTION

The present invention relates to a troffer or light fixture typically supported in or on a ceiling and having releasable lens and reflector assemblies that can readily expose a ballast for service, installation or replacement when in their open positions. More particularly, the invention relates to a light fixture having a ballast mounted to an interior surface of a housing and reflector and lens assemblies releasably coupled to the housing and enclosing the ballast within the housing when the reflector and lens assemblies are in closed positions and exposing the ballast when the reflector and lens assemblies are in open positions, spaced from at least a portion of the housing. This construction provides relatively easy access to the ballast from below the ceiling-mounted fixture.

BACKGROUND OF THE INVENTION

Numerous lighting fixtures for directly illuminating areas are known. A common lighting assembly used in ceilings of commercial buildings includes a troffer with one or more downwardly-facing fluorescent lamps mounted therein. The lighting fixture can have a removable grid or reflector attached to the housing to allow access to the lamps for replacement. The reflectors are generally mounted to the housing. Other forms of lighting assemblies include a hinged or removable cover and a lens and reflector that cooperate with the lamps. The lamps are positioned inside the lens and the reflector is spaced from the lens to direct the light to preselected areas to be illuminated.

Common light fixtures using fluorescent lamps also include an electrical ballast to adjust the current to the lamps. A ballast has a limited life and must be replaced after failure. Often, light fixtures must be partially disassembled, removing pieces of the cover and housing, to access the ballast for replacement. Other light fixtures require a repair person to access the troffer from above the ceiling, maintaining the positions of the reflectors and lens, to replace the ballast. These methods of replacing the ballast are labor intensive, requiring a repair person to gain access to the troffer through the ceiling or requiring disassembling portions of the troffer, making multiple trips from the ceiling where the troffer is mounted, to the floor or nearby repair area.

Examples of these prior troffers and light fixtures are disclosed in the following U.S. Pat. No. 5,440,466 to Belise et al. and U.S. Pat. No. 6,059,424 to Kotloff, the disclosures of which are hereby incorporated herein by reference.

Thus, there is a continuing need to provide improved access for replacement of electrical ballasts.

SUMMARY OF THE INVENTION

Accordingly, it is a primary object of the embodiments of the invention to provide a light fixture with a ballast that is readily and easily accessible from a location beneath the fixture and without disassembling the fixture.

A further object of the embodiments of the invention is to reduce the steps and complexity required to install, inspect, service or replace the ballast of a troffer or light fixture.

The foregoing objectives are basically attained by a light fixture assembly that includes a housing having an interior surface; a ballast mounted on the interior surface of the housing; a first reflector releasably coupled to the interior surface of the housing, the ballast being substantially enclosed between the housing and the first reflector when the first reflector is in a first, closed position and being exposed when the first reflector is in a second, open position spaced from at least a portion of the interior surface; and a lens releasably coupled to the housing, the first reflector being substantially enclosed between the lens and the housing when the lens is in a first, closed position and substantially exposed when the lens is in a second, open position.

The foregoing objectives are further obtained by a lighting fixture that includes a housing having a back wall, and a first side wall and a second side wall extending from the back wall; a ballast mounted on the back wall of the housing; a reflector coupled to the first side wall and releasably coupled to the back wall, the ballast being located between the reflector and the back wall of the housing when the reflector is in a first, closed position and being exposed when the reflector is in a second, open position spaced from at least a portion of the back wall; and a lens coupled to the first side wall and releasably coupled to the second side wall, the reflector being substantially enclosed between the lens and the back wall when the lens is in a first, closed position and being exposed when said lens is in a second, open position spaced from at least a portion of the second side wall.

Other objects, advantages and salient features of the embodiments of the invention will become apparent from the following detailed description, which, taken in conjunction with the annexed drawings, discloses a preferred embodiment of the invention.

BRIEF DESCRIPTION OF THE DRAWINGS

The above benefits and other advantages of the various embodiments of the present invention will be more apparent from the following detailed description of an exemplary embodiment of the present invention and from the accompanying drawing figures, in which.

Throughout the drawings, like reference numbers will be understood to refer to like parts, components and structures.

DETAILED DESCRIPTION OF THE EXEMPLARY EMBODIMENT

Figure 1:
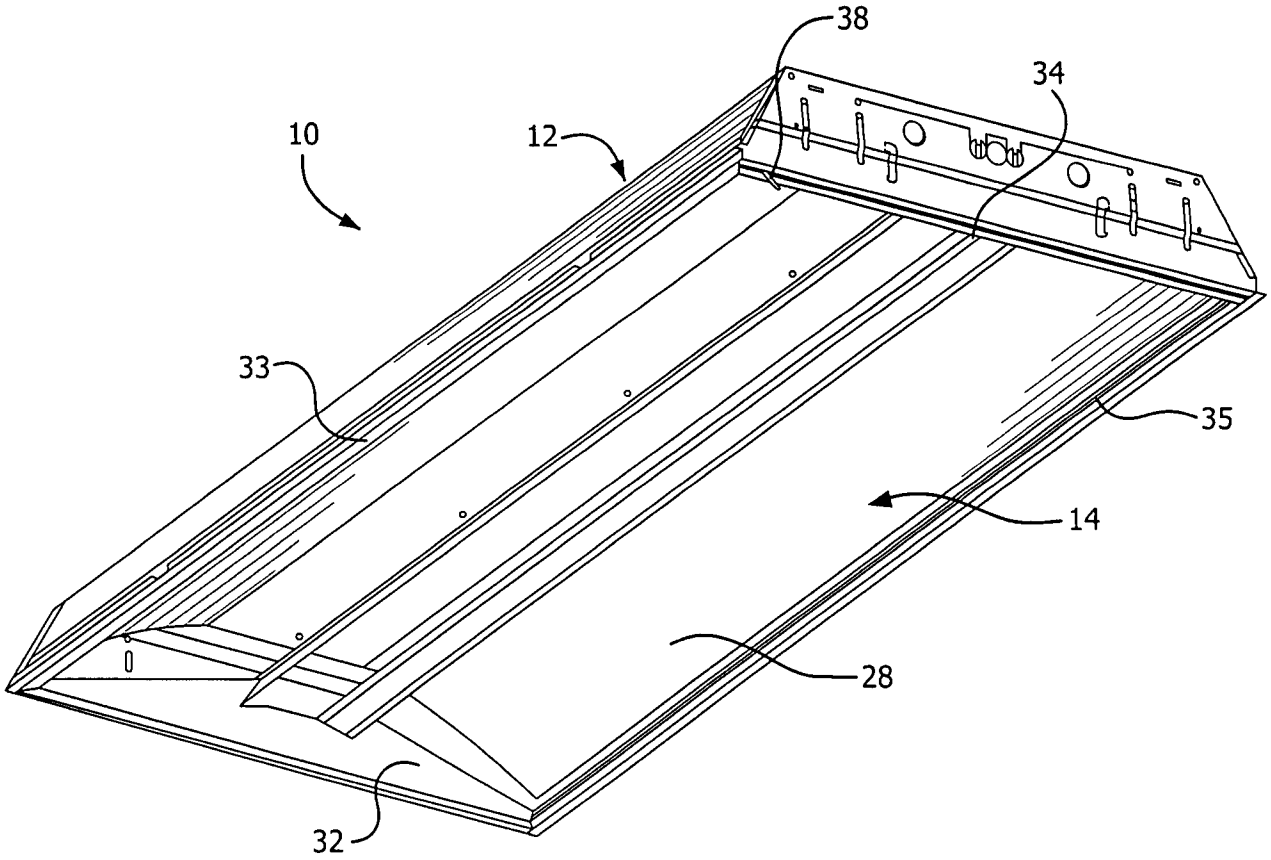
FIG. 1 is a bottom perspective view of a light fixture assembly having a closed reflector assembly and lens assembly, according to an exemplary embodiment of the present invention.
Figure 4:
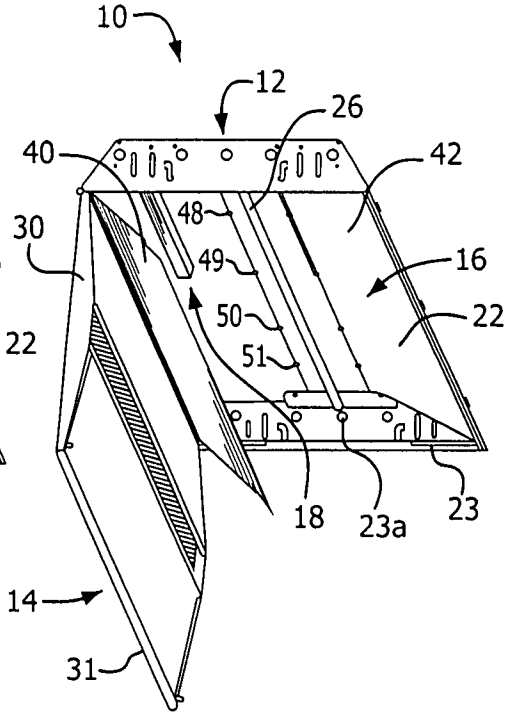
FIG. 4 is a bottom perspective view of the light fixture assembly of FIG. 1, having an opened lens assembly and an opened reflector assembly exposing a ballast.

As shown in FIGS. 1-9, a light fixture assembly 10 in accordance with an embodiment of the invention includes a housing 14, a lens assembly 16, a reflector assembly 16 and a ballast 18. The lens assembly 12 and reflector assembly 14 are releasably coupled to the housing 12. The lens assembly 14 and reflector assembly 16 can each pivot from a closed position as shown in FIG. 1 to an open position shown sequentially in FIGS. 2-4. As shown in FIG. 4, when the lens assembly 14 and the reflector assembly 16 are in open positions the ballast 18, mounted to a back wall 20 of the housing 12, is exposed and readily accessible for repair or replacement.

The housing 12 includes a plurality of substantially planar side walls 21-24 coupled to the substantially planar back wall 20, as shown in FIGS. 1-4. Side walls 21 and 23 are substantially parallel and include lamp sockets 21*a* and 23*a*, respectively. Lamp sockets 21*a* and 23*a* can receive and provide power to fluorescent lamp 26 and additional lamps not shown. Side walls 21 and 23 may have a trapezoidal shape, as shown in FIGS. 1-4, or any other desired shape. Side walls 22 and 24 are coupled to side walls 21 and 23 and back wall 20.

Lens assembly 14 includes a fluorescent lens 28 and frame 30. Lens 28 is a 3-element diffuser that combines a performance-optimized center optic 28*a* and two high-transmission, linear prismed side lenses 28*b* to enable improved efficiency and a batwing distribution. Alternative lenses of varying shape and composition can also be utilized without compromising the objectives of the embodiments of the invention. Frame 30 includes four side walls 32-35 that receive lens 28. Frame 30 provides support and rigidity to the lens 28 and can be manufactured of metal, rigid plastic or any other desired substantially rigid material.

Figure 6:
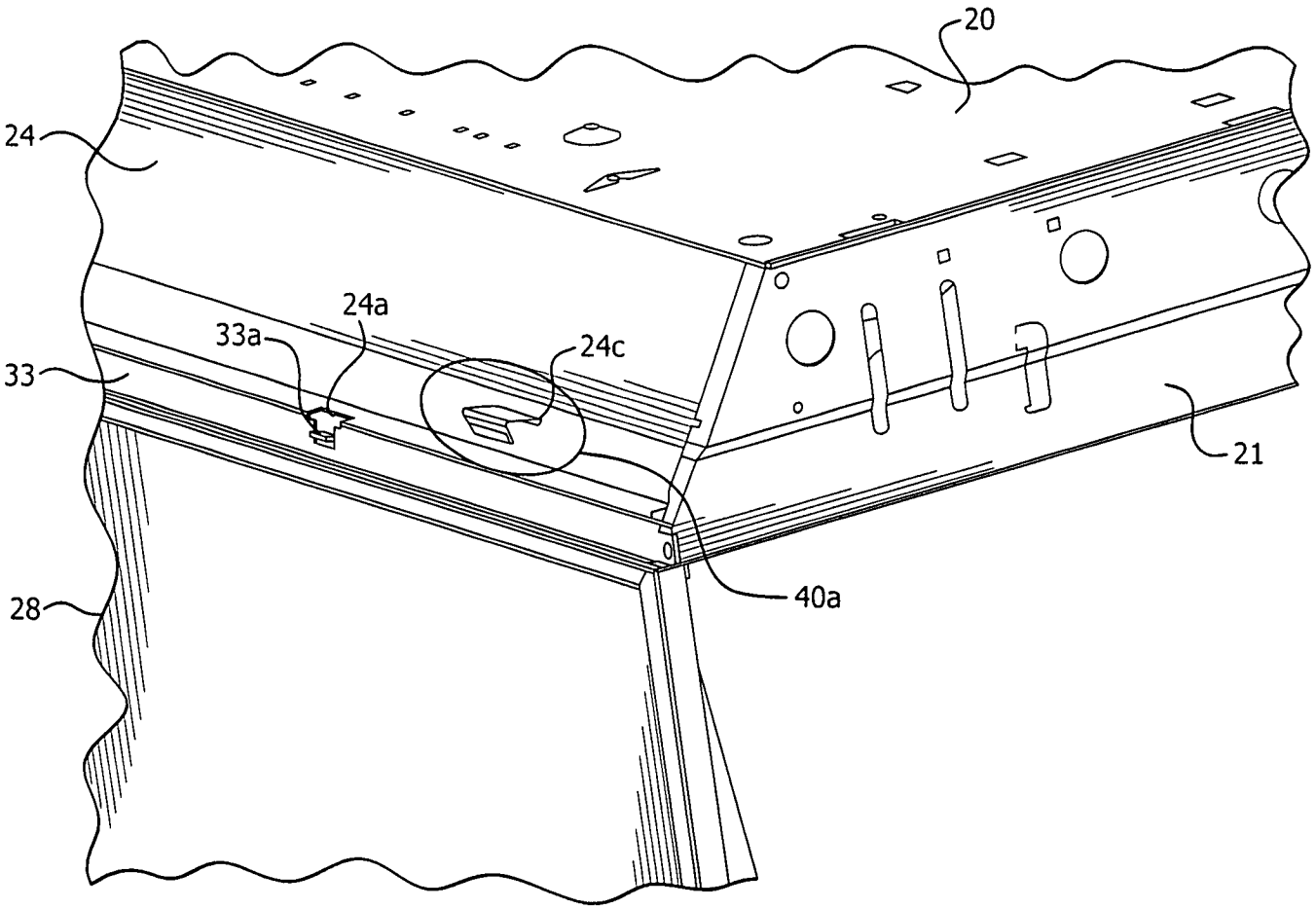
FIG. 6 is an enlarged, left perspective view of the light fixture assembly of FIG. 1, having an opened lens assembly and a closed reflector assembly.
Figure 7:
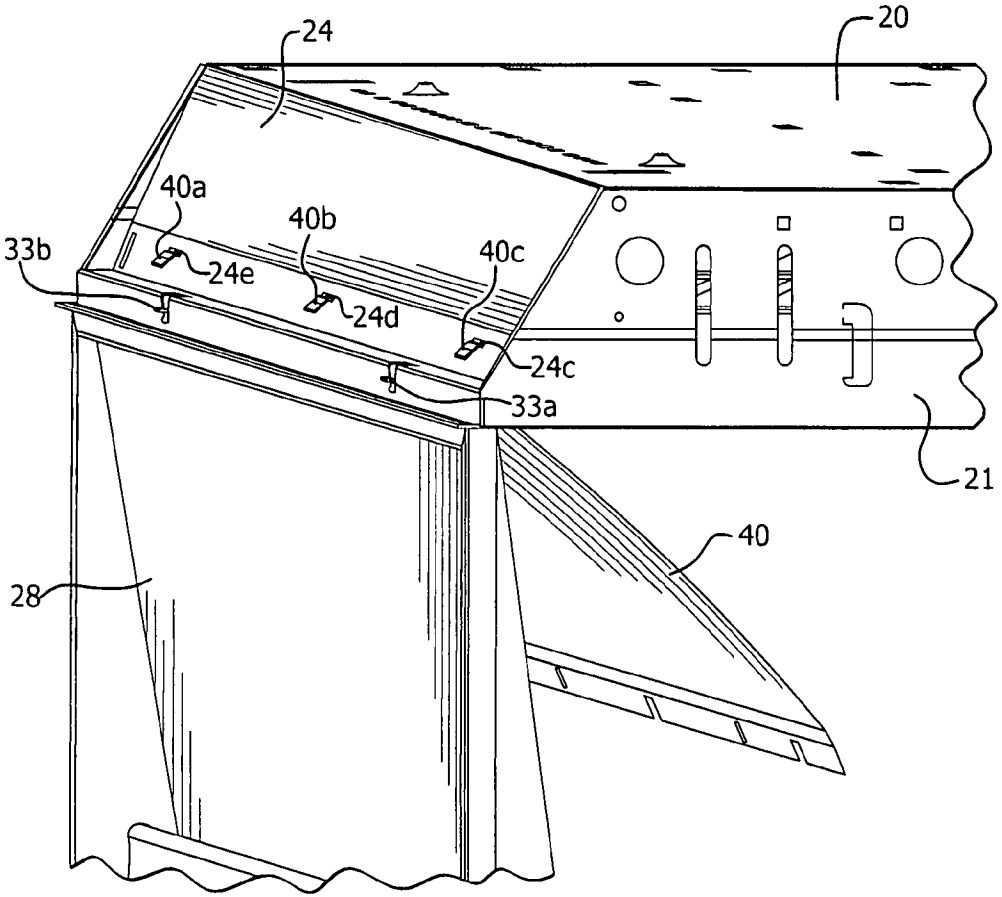
FIG. 7 is an enlarged, left perspective view of the light fixture assembly of FIG. 1, having an opened lens assembly and an opened reflector assembly.
Figure 8:
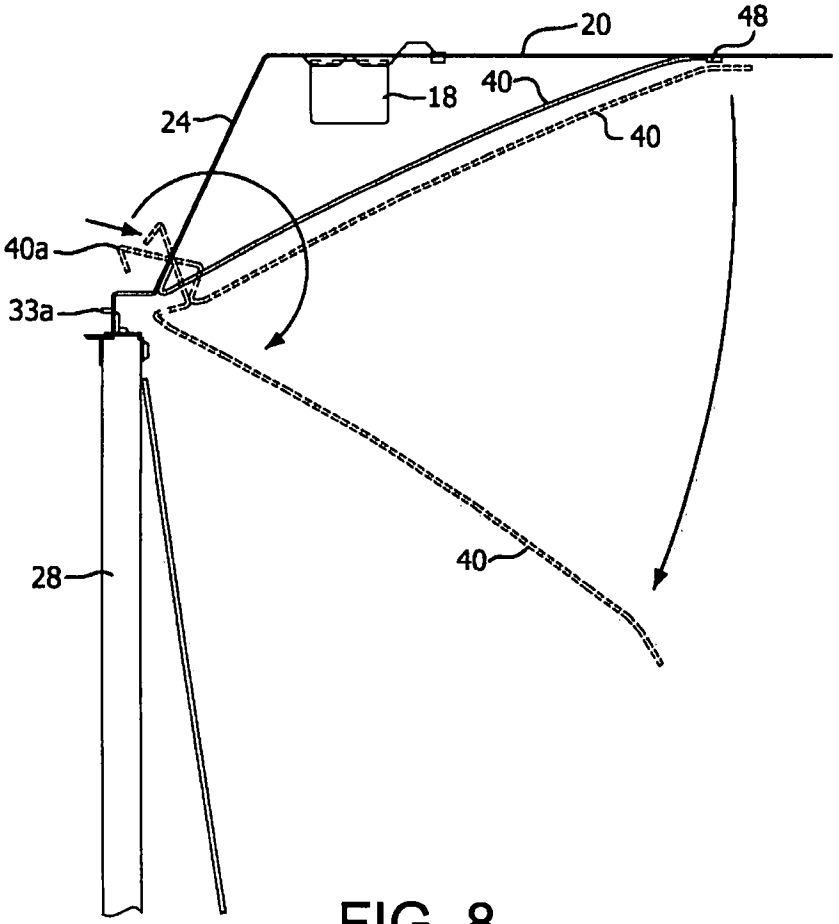
FIG. 8 is an enlarged, cross-sectional view in elevation of the light fixture assembly of FIG. 1, having an opened lens assembly and an opened reflector assembly.
Figure 9:
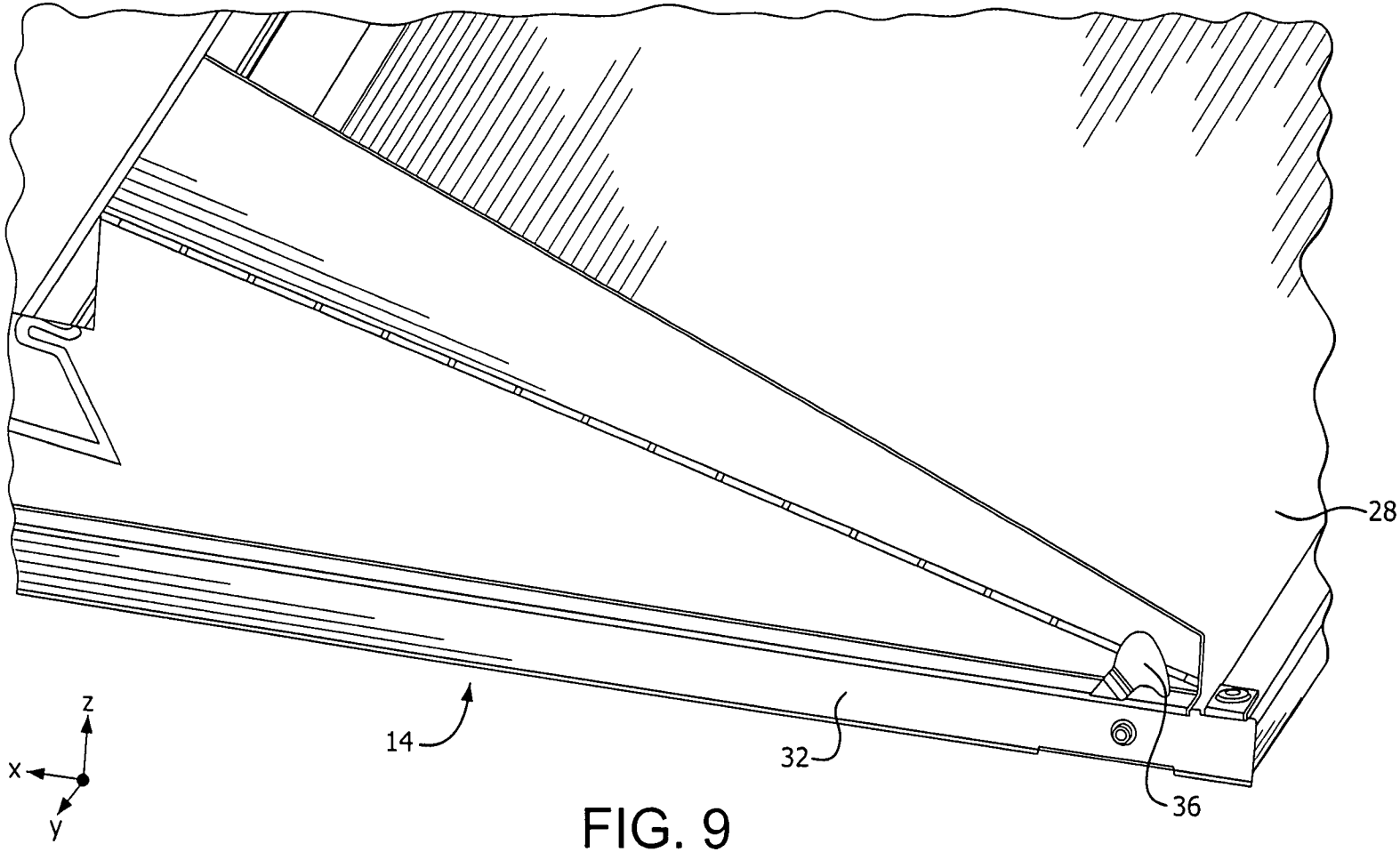
FIG. 9 is an enlarged, right perspective view of the lens assembly of FIG. 1 including a latch.

Frame side wall 33 includes male keys 33*a* and 33*b* that mate with respective key holes 24*a* and 24*b* of housing side wall 24. Engagement of the mating keys 33*a* and 33*b* and key holes 24*a* and 24*b*, as shown in FIGS. 6 and 7, facilitates pivoting of the lens assembly 14 with respect to the housing 12. This engagement also maintains connection between the lens assembly 14 and the housing 12 when the lens assembly 14 is in a fully opened position as shown in FIG. 4. Alternative hinging mechanisms known in the art can also be used in place of the mating keys 33*a* and 33*b* and key holes 24*a* and 24*b* to provide a pivoting engagement between the lens assembly 14 and the housing 12. Frame side walls 32 and 34 include latches 36 and 38, respectively. Latches 36 and 38 engage with flange 22*a* of housing side wall 22 when the lens assembly 14 is in a closed position and release from flange 22*a* when the lens assembly is moved into the open position. Alternative latching or fastening mechanisms known in the art can also be utilized, for example bolts, magnets or cam locks.

Reflector assembly 16 includes a first reflector 40 and a second reflector 42. Each of reflectors 40 and 42 are substantially planar and are manufactured to have at least one reflective surface for reflecting light emitted from lamp 26. The first reflector 40, as shown in FIGS. 6 and 7, includes hinges 40*a*-40*c* that pivotally engage housing side wall 24 through corresponding openings 24*c*-24*e*. As shown in FIG. 6, when the first reflector 40 is in a closed position hinge 40*a* extends through opening 24*c* with the bent portion of the hinge 40*a* spaced from the side wall 24, which prevents disengagement of the reflector 40 from the side wall 24. As the first reflector 40 is moved to an open position, as shown in FIG. 7, the bent portions of hinges 40*a*-40*c* fully engage the side wall 24, preventing the hinges 40*a*-40*c* from sliding out through the openings 24*c*-24*e*. Alternative hinging mechanisms known in the art can also be used in place of the hinges 40*a*-40*c* to provide a pivoting engagement between the first reflector 40 and the housing 12.

The first reflector 40 also includes a plurality of slits 44-47 configured to receive respective fasteners 48-51 that releasable couple the first reflector 40 to an interior surface of the housing back wall 20. By coupling the first reflector simultaneously to the back wall 20 and the side wall 24 the first reflector 40 is positioned at an angle with respect to the back wall 20 and lamp 26, thus directing light emitted from the lamp 26 in a desired direction. The fasteners 48-51 can be ¼ turn fasteners, as shown FIG. 5, that are retained in engagement with the back wall 20 after being turned to a release position, releasing engagement of the first reflector 40 from the back wall 20. The ¼ turn fasteners 48-51 enable a user to release the first reflector 40, moving it to an open position, without removing the fasteners from the reflector. Alternative fasteners may also be used, for example, bolts, magnets or latches.

The second reflector 42 may include similar hinge and fastening features as those disclosed above with respect to the first reflector 40 or, alternatively, the second reflector 42 can be permanently fixed to both the back wall 20 and side wall 22. The hinging operation of the first and second reflectors 40 and 42 are mutually exclusive, enabling the first and second reflectors 40 and 42 to open individually or at the same time.

The ballast 18 is utilized to adjust the current through the fluorescent lamp 26. The ballast 18 is releasably mounted to the interior surface of the back wall 20 to enable installation, service or replacement of a defective or inoperative ballast. Any conventional or custom ballast may be used.

Figure 10:
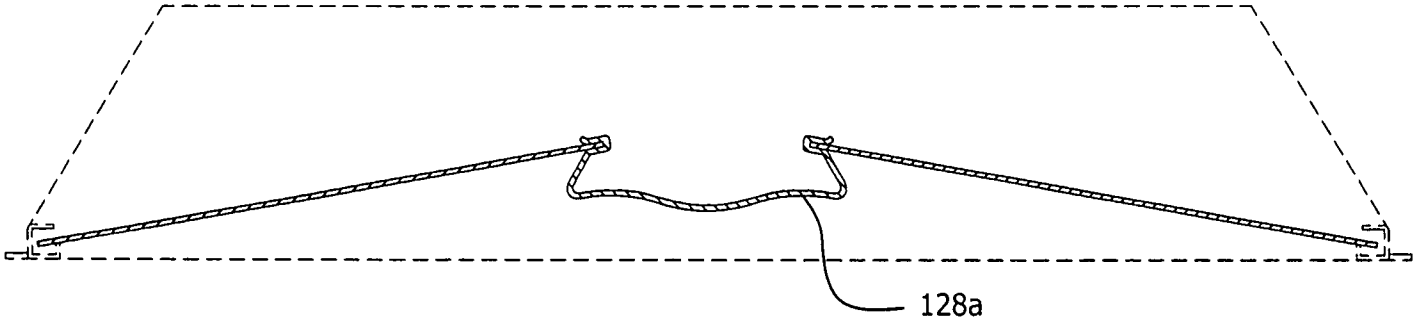
FIG. 10 is a cross-sectional view in elevation of an alternative center optic.
Figure 11:
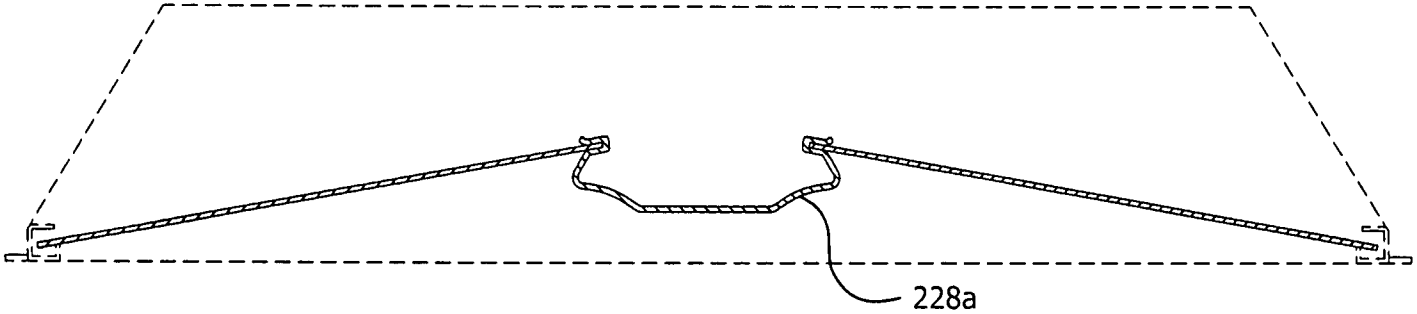
FIG. 11 is a cross-sectional view in elevation of further alternative center optic.

FIGS. 10 and 11 disclose alternative center optics 128*a* and 228*a* which can be used interchangeably with the center optic 28*a*. Center optics 128*a* and 228*a* provide alternative aesthetic configurations.

OPERATION

The light fixture assembly 10, including a housing 12, lens assembly 14, reflector assembly 16, and ballast 18, enables a user to readily and easily access the ballast 18 from a location beneath the light fixture 10 without disassembling the light fixture 10. Light fixture 10 also reduces the steps and complexity required to replace the ballast 18 when it becomes inoperable, as generally shown in FIGS. 1-4.

During the first step of replacing the ballast 18, the lens assembly 14 is released from engagement with the housing side wall 22 by disengaging latches 36 and 38 from side wall flange 22*a*. Once the latches 36 and 38 are disengaged, the lens assembly 14 is pivoted away from the housing 12 to an open position. Keys 33*a* and 33*b* are configured to retain the lens assembly 14 in pivotal engagement with side wall 24 while in the open position.

Figure 3:
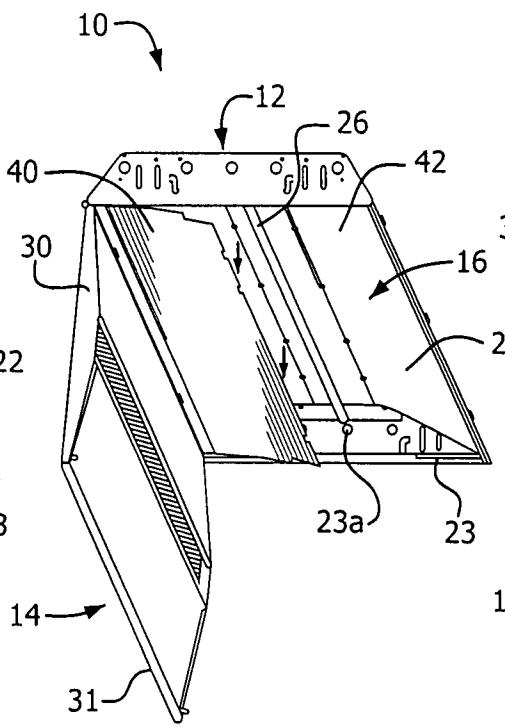
FIG. 3 is a bottom perspective view of the light fixture assembly of FIG. 1, having an opened lens assembly and a partially opened reflector assembly.
Figure 2:
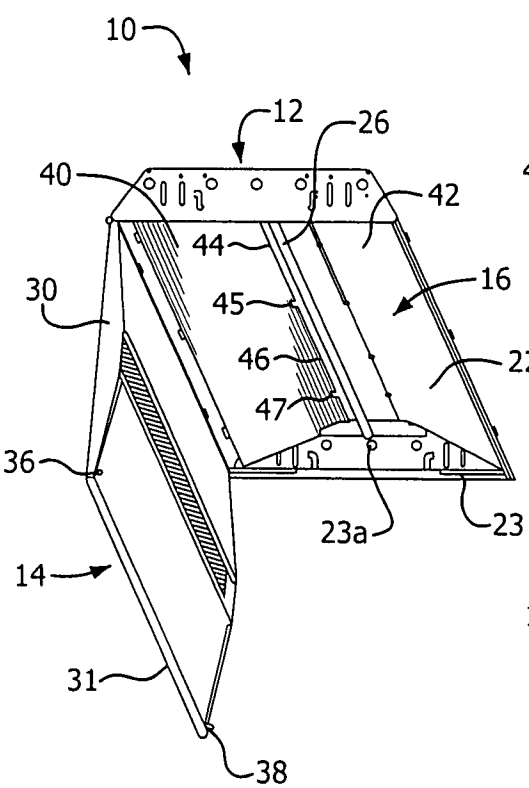
FIG. 2 is a bottom perspective view of the light fixture assembly of FIG. 1, having an opened lens assembly and a closed reflector assembly.
Figure 5:
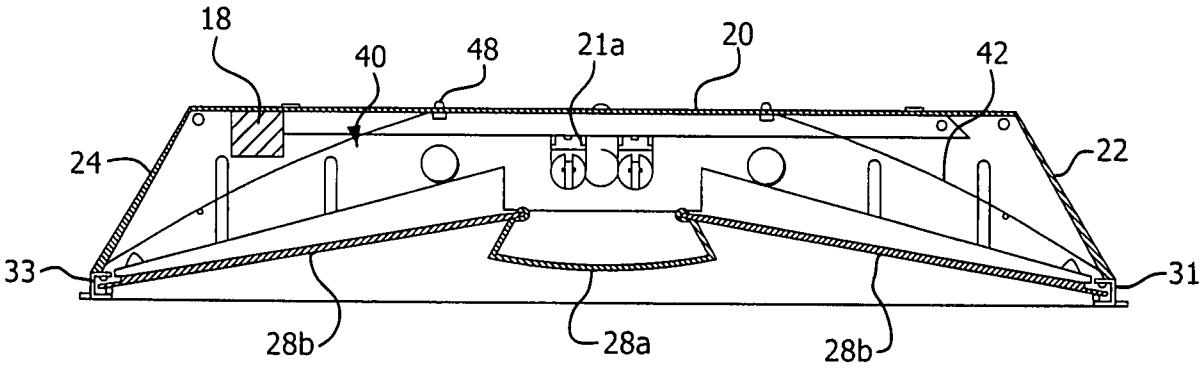
FIG. 5 is a cross-sectional view in elevation of the light fixture assembly of FIG. 1.

Second, the first reflector 40 is released from engagement with the housing back wall 20 by turning ¼ turn fasteners 48-51 until they disengage from housing back wall 20. The first reflector 40 is then released from engagement with the back wall 20 and pivoted away from the back wall 20 to an open position. As shown in FIGS. 2-4, the first reflector 40 is pivoted away from the back wall 20 to the open position without removal of the lamp 26. Hinges 40*a*-40*c* are configured to retain the first reflector 40 in pivotal engagement with the side wall 24 while in the open position. When the first reflector is in the open position the ballast 18, mounted to the back wall 20, is exposed and readily accessible by a user.

Third, the ballast 18 can be removed by disengagement of the conventional fastening means (not shown) and replaced by a new or otherwise fully operational ballast.

Fourth, the first reflector 40 is pivoted back into a closed position in engagement with the back wall 20, enclosing the ballast 18 between the first reflector and the back wall 20. ¼ turn fasteners 48-51 are then turned until fully engaged with the back wall 20.

Fifth, the lens assembly 14 is pivoted back into a closed position in engagement with the side wall 22, enclosing the first reflector 40 between the lens assembly 14 and the back wall 20. Latches 36 and 38 are then reengaged with the side wall flange 22*a* in a locked position.

In other exemplary embodiments of the invention an additional ballast may be releasably mounted to the interior surface of the back wall 20 at a location enclosed by the second reflector 42 and the back wall 20. In such an embodiment, the same steps for replacing the ballast 18 disclosed above may be used with respect the additional ballast and the second reflector 42.

This disclosed method of replacing the ballast 18 can be accomplished from a location beneath the fixture without disassembling the light fixture 10 or removing fasteners.

While an advantageous embodiment has been chosen to illustrate the invention, it will be understood by those skilled in the art that various changes and modifications may be made therein without departing from the scope of the invention as defined in the appended claims.

The foregoing embodiments and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims.

What is claimed is:

1. A light fixture assembly comprising:

a housing having an interior surface;

a ballast mounted on said interior surface of said housing;

a first reflector releasably coupled to said interior surface of said housing and pivotally coupled to said housing, said ballast being substantially enclosed between said housing and said first reflector when said first reflector is in a first, closed position and being exposed when said first reflector is in a second, open position spaced from at least a portion of said interior surface; and a lens releasably coupled to said housing and independently moveable of said first reflector, said first reflector being substantially enclosed between said lens and said housing when said lens is in a first, closed position and substantially exposed when said lens is in a second, open position, wherein said first reflector and said lens are moveable from said first, closed position to said second, open position without removal of a lamp.

2. The light fixture assembly of claim 1, wherein said first reflector remains mounted to said housing when said first reflector is in said second, open position.

3. The light fixture assembly of claim 1, wherein said lens is pivotally coupled to said housing at one side.

4. The light fixture assembly of claim 3, wherein said lens remains coupled to said housing when said lens is in said second, open position.

5. The light fixture assembly of claim 3, wherein said lens includes a male key and said housing includes a key hole receiving said male key to pivotally connect said lens to said housing.

6. The light fixture assembly of claim 1, wherein said first reflector extends at an angle from said interior surface of said housing when, coupled thereto.

7. The light fixture assembly of claim 1 and further comprising a second reflector pivotally coupled to said interior surface of said housing and pivotable independent of said first reflector.

8. The light fixture assembly of claim 1 and further comprising the lamp coupled to said housing and located vertically between said first reflector and said lens.

9. The light fixture assembly of claim 1, wherein said reflector includes a hinge having a bent portion and said housing includes an opening receiving said hinge to pivotally connect said reflector to said housing.

10. The light fixture assembly of claim 1, wherein said lens is pivotally coupled to said housing at a first position and said reflector is pivotally coupled to the housing at a second position spaced from said first position.

11. A light fixture comprising:

a housing having a back wall, and a first side wall and a second side wall extending from said back wall;

a ballast mounted on said back wall of said housing;

a reflector pivotally coupled to said first side wall and releasably coupled to said back wall, said ballast being located between said reflector and said back wall of said housing when said reflector is in a first, closed position and being exposed when said reflector is in a second, open position spaced from at least a portion of said back wall; and a lens coupled to said first side wall and releasably coupled to said second side wall, said reflector being substantially enclosed between said lens and said back wall when said lens is in a first, closed position and being exposed when said lens is in a second, open position spaced from at least a portion of said second side wall, wherein said first reflector and said lens are moveable from said first position to said second open position without removal of a lamp.

12. The light fixture of claim 11, wherein said lens is pivotally coupled to said first side wall.

13. The light fixture of claim 12, wherein said lens remains coupled to said first side wall when said lens is in said second, open position.

14. The light fixture of claim 12, wherein said lens includes a male key and said housing includes a key hole receiving said male key to pivotally connect said lens to said housing.

15. The light fixture of claim 11, wherein said reflector remains coupled to said first side wall when said reflector is in said second, open position.

16. The light fixture of claim 11, wherein said reflector is releasably coupled to said back wall via at least ¼ turn fastener.

17. The light fixture of claim 11, wherein said lens is releasably coupled to said second wall via a latch in said first, closed position.

18. The light fixture of claim 11 and further comprising the lamp coupled to said housing and located vertically between said reflector and said lens.

19. The light fixture of claim 11 and further comprising a second reflector releasably coupled to said back wall, wherein said second reflector is releasable from said back wall independent of said reflector coupled to said first side wall.

20. The light fixture assembly of claim 11, wherein said reflector includes a hinge having a bent portion and said housing includes an opening receiving said hinge to pivotally connect said reflector to said housing, wherein when said reflector is in said open position, said bent portion engages said first side wall of said housing, preventing said hinge from sliding through said opening.

* * * * *